US010246916B1

(12) United States Patent
Kessler

(10) Patent No.: US 10,246,916 B1
(45) Date of Patent: Apr. 2, 2019

(54) DOOR HINGES AND METHOD FOR REHANGING A DOOR TO REALIGN THE DOOR IN RELATION TO A DOOR JAMB

(71) Applicant: Tyler L. Kessler, Overland Park, KS (US)

(72) Inventor: Tyler L. Kessler, Overland Park, KS (US)

( * ) Notice: Subject to any disclaimer, the term of this patent is extended or adjusted under 35 U.S.C. 154(b) by 45 days.

(21) Appl. No.: 15/153,393

(22) Filed: May 12, 2016

Related U.S. Application Data

(60) Provisional application No. 62/160,407, filed on May 12, 2015.

(51) Int. Cl.
*E06B 3/00* (2006.01)
*E05D 5/14* (2006.01)
*E05D 3/02* (2006.01)

(52) U.S. Cl.
CPC ..... *E05D 5/14* (2013.01); *E05D 3/02* (2013.01); *E05Y 2900/132* (2013.01)

(58) Field of Classification Search
CPC ..... Y10T 16/558; Y10T 16/5326; E05D 5/14; E05D 3/02; E05Y 2900/132
See application file for complete search history.

(56) References Cited

U.S. PATENT DOCUMENTS 226,306 A * 4/1880 Gordon ..... E05D 3/02 16/387
477,465 A * 6/1892 Smith ..... E05D 3/02 16/372
480,238 A * 8/1892 Ranker ..... E05D 3/02 16/389
880,317 A 2/1908 Von De Marwitz
1,105,666 A * 8/1914 Johnson ..... E05D 3/02 16/388
1,474,418 A * 11/1923 Larson ..... E05D 3/02 16/374
1,606,048 A * 11/1926 Soss ..... E05D 3/02 16/389
1,745,773 A * 2/1930 Sipe ..... E05D 3/02 16/375
2,004,810 A * 6/1935 Hines ..... B21D 53/40 16/385
2,112,312 A * 3/1938 Smith ..... E05D 3/02 16/387
2,211,581 A * 8/1940 Ross ..... E05D 3/02 16/364

(Continued)

*Primary Examiner* — Jerry E Redman
(74) *Attorney, Agent, or Firm* — Harness, Dickey & Pierce, P.L.C.

(57) ABSTRACT

A kit for use in rehanging a sagging door connected to a door jamb included a plurality of replacement hinges having different sized gaps between the leaves of the hinges when pivoted to extend in parallel, juxtaposed alignment, including gaps that are larger and smaller than the gaps of the conventional hinges originally used to hang the door. The smaller gap replacement hinge may have no gap between the hinge leaves when pivoted to parallel and juxtaposed alignment. The kit may include multiple reduced gap hinges with varying sized gaps and multiple enlarged gap hinges with varying sized gaps. To rehang the sagging door, the original, top hinge is replaced with a reduced gap hinge and the original, bottom hinge may be replaced with an enlarged gap hinge.

8 Claims, 5 Drawing Sheets

(56) References Cited

U.S. PATENT DOCUMENTS

| | | | | | |
|---|---|---|---|---|---|
| 2,330,455 | A * | 9/1943 | Steckel | E05D 7/0423 | 16/247 |
| 2,940,115 | A | 6/1960 | Hansen | | |
| 3,229,323 | A * | 1/1966 | Hensgen | E05D 7/04 | 16/247 |
| 3,445,883 | A * | 5/1969 | Lowe | E05D 5/04 | 16/387 |
| 3,526,922 | A * | 9/1970 | Kellems | E05D 5/04 | 16/387 |
| 3,811,150 | A * | 5/1974 | Chalmers | E05D 11/1007 | 16/352 |
| 4,825,507 | A | 5/1989 | Killingstad | | |
| 5,694,665 | A | 12/1997 | Strickland et al. | | |
| 5,701,636 | A | 12/1997 | Jahnke | | |
| 5,799,370 | A | 9/1998 | Davidian et al. | | |
| 6,158,086 | A * | 12/2000 | De Souza | E05D 7/04 | 16/237 |
| 7,516,517 | B2 | 4/2009 | Fries | | |
| 7,694,388 | B2 | 4/2010 | Campbell et al. | | |
| 8,490,246 | B2 | 7/2013 | Waddell | | |
| 2002/0162193 | A1* | 11/2002 | Frys | E05D 11/00 | 16/387 |
| 2008/0052873 | A1* | 3/2008 | Campbell | E05D 7/0415 | 16/245 |
| 2008/0276418 | A1* | 11/2008 | Peters | E05D 11/0027 | 16/221 |
| 2012/0005859 | A1 | 1/2012 | Herglotz et al. | | |
| 2014/0020209 | A1* | 1/2014 | Hsu | G06F 1/1681 | 16/386 |
| 2014/0259523 | A1* | 9/2014 | Karcher | E05D 11/00 | 16/82 |
| 2014/0298618 | A1* | 10/2014 | Karonis | E05D 11/00 | 16/386 |

* cited by examiner

DOOR HINGES AND METHOD FOR REHANGING A DOOR TO REALIGN THE DOOR IN RELATION TO A DOOR JAMB

CROSS-REFERENCE TO RELATED APPLICATIONS

This application claims the benefit of U.S. Provisional Patent Application No. 62/160,407, filed May 12, 2015, the disclosure of which is hereby incorporated herein in its entirety by reference.

FIELD OF THE INVENTION

This invention relates to door hinges and a method of rehanging a door in a door frame so it does not sag.

BACKGROUND OF THE INVENTION

Due to their weight, heavy doors will often sag due to the strain exerted on the hinges and the door frame or jamb on which the doors are hung. Most solid wood doors are connected to the door frame by three hinges. Gravity pulls downward on the door. For doors mounted to a frame by hinges on one side, the gravitational forces tend to pull the top of the door away from the hinge side of the frame and push the bottom of the door towards the hinge side of the frame.

The gravitational forces acting on the hinge leaves may cause the leaves of the top hinge to bend or distort. The leaf connected to the door is pulled away from the door jamb and the leaf of the hinge connected thereto such that the spacing between the leaves increases. In addition, the wood forming the door jamb at the top of the door frame on the hinge side, may also be pulled away from the framing to which it is attached such that the top corner of the door opposite the top hinge gradually pivots into engagement with the top part of the jamb opposite the hinges.

Similarly, as gravity pulls the bottom of the door downward and toward the side of the door frame to which the hinges are connected, the leaves forming the bottom hinge may be compressed, narrowing the gap between the leaves. In addition, the outwardly or horizontally directed component of the gravitational forces acting on the hinge mounted door tend to compress the portion of the jamb to which the bottom hinge is connected or pushes that portion of the jamb outward which gradually pulls the opposite side of the bottom of the door away from the jamb opposite the hinges.

The gap between the door and the jamb may be referred to as a reveal and a uniform reveal of approximately on quarter of an inch is preferably formed between the door and the jamb to allow the door to pivot out from the frame without hitting the jamb. When a door sags in the manner described above, the reveal between the top corner of the door and the jamb opposite the hinges is generally eliminated and the reveal between the top corner of the door and the jamb adjacent the hinges is widened. Similarly, the reveal between the bottom corner of the door and the jamb opposite the hinges widens and the reveal between the bottom corner of the door and the jamb adjacent the bottom hinge is narrowed.

Options for repairing a sagging door have included driving longer screws through the holes of the leaf of the top hinge connected to the jamb to draw the top part of the jamb to which the hinge is attached outward. It is also known to replace the standard hinges with an adjustable hinge such as the adjustable hinge shown in U.S. Pat. No. 8,490,246 in which the leaf attached to the door incorporates an adjustment mechanism to adjust the width of the gap between the leaves of the hinge when the door is closed. However, the adjustable leaf of this hinge and similar type hinges is relatively thick requiring routing out a recess in the door or a deeper recess in the jamb to receive the thicker leaf.

There remains a need for an easier option for repairing a sagging door that is inexpensive and is relatively easy to implement.

SUMMARY OF THE INVENTION

The present invention involves altering the reveal of a door by replacing one or more of the originally installed, conventional hinges with one or more replacement hinges of different spacing between the leaves of the hinges in the closed position in which the hinges extend in parallel alignment. The replacement hinges may be sold individually or as a kit comprising multiple replacement hinges with different spacing between the hinge leaves and with instructions on installing. The replacement hinges and method are particularly suited for use with relatively heavy wood or composite doors mounted on wood frames which may for an entry door for a residence or other solid core doors used in a residence. The replacement hinges used preferably comprise a first hinge or reduced gap replacement hinge having a reduced dimension gap between the leaves of the hinge when pivoted to a closed position in which the leaves extend in parallel, juxtaposed alignment including a reduced dimension gap which may be zero or no gap. The reduced gap replacement hinge is often used to replace the top hinge of a door which has sagged. The replacement hinges used may also include a second hinge or enlarged gap replacement hinge having a larger gap between the leaves of the hinge when pivoted to a closed position with the leaves extending in parallel, juxtaposed alignment.

The change in the width of the gap is created without changing the general size of the knuckles or the pivot pin forming the hinges. The gap formed between each of the hinges is fixed and not adjustable and replacement hinges of a variety of different gap spacing may be produced to accommodate a wide variety of adjustments to the spacing between the door and the jamb. Use of the hinges allows rehanging of a door relative to the door jamb to eliminate the sagging without having to change the mortise size in the door and the door jamb or without the use of wedges or shims. Once the hinges are replaced no further adjustment is necessary.

DETAILED DESCRIPTION OF THE PREFERRED EMBODIMENTS

Figure 1:
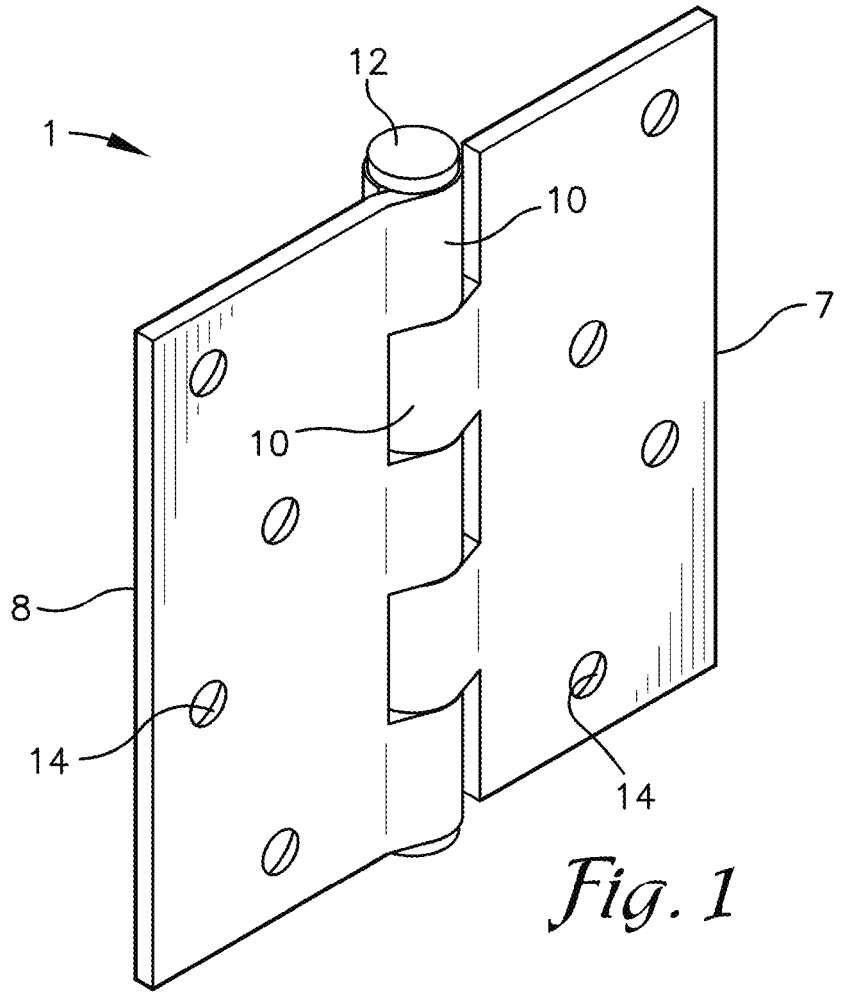
FIG. 1 is a perspective view of a conventional hinge for connecting a door to a door jamb.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 2:
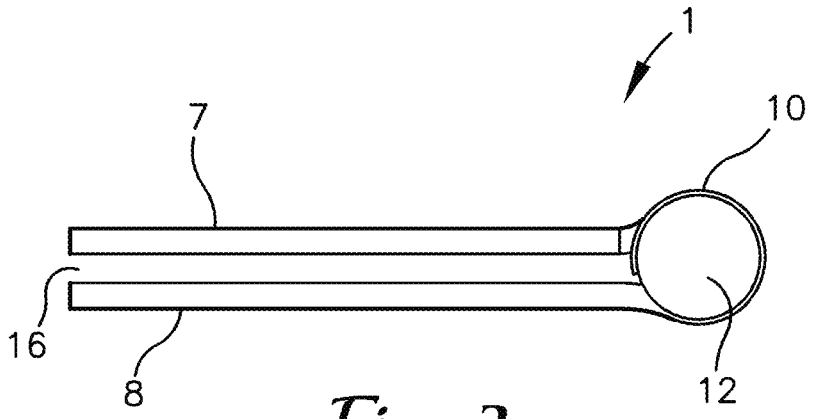
FIG. 2 is an end view of a conventional hinge in a closed position with the leaves of the hinge extending in parallel spaced relation with a gap formed therebetween.

A conventional hinge 1 for pivotally connecting a door 2 to a jamb 3 of a door frame 4 is shown in FIGS. 1 and 2. The hinge includes first and second leaves 7 and 8 each with a plurality of knuckles 10 which when aligned receive a hinge pin 12 therethrough about which the leaves 7 and 8 pivot. Fastener holes 14 are formed in each leaf 7 and 8 through which fasteners, preferably wood screws, are driven to secure the leaves 7 and 8 to door 2 or door jamb 3. The leaves 7 and 8 of a conventional hinge 1 project outward from their respective knuckles 10 such that when the leaves are pivoted to a closed alignment with the leaves extending parallel and adjacent to one another, a gap 16, generally corresponding in width to the desired width of the reveal between the door 2 and jamb 3 is formed between the leaves 7 and 8. In a preferred embodiment, the gap 16 for conventional hinges prior to installation, is between ⅛ to ¼ inch wide. For standard eight foot doors 2, three hinges 1 are typically used to connect the door 2 to the jamb 3, a top hinge 1*a*, middle hinge 1*b* and bottom hinge 1*c*. After installation the weight of the door 2 will generally cause the gap 16 of the top hinge 1*a* to expand and the gap 16 of the bottom hinge 1*c* to compress.

Figure 3:
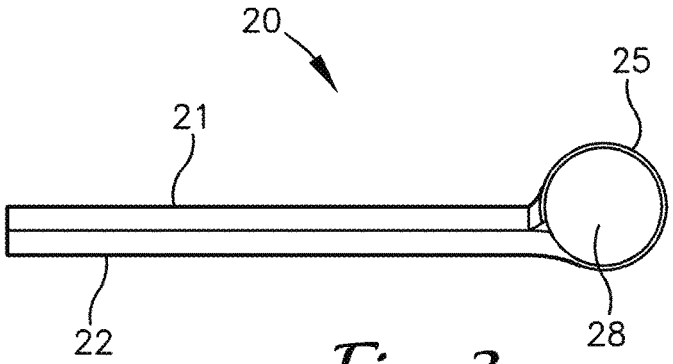
FIG. 3 is an end view of a first modified hinge which has been modified to eliminate the gap between the leaves of the hinge when extending in parallel spaced relation.

Referring to FIG. 3, there is shown a first modified hinge, first replacement hinge or reduced gap hinge 20 having first and second leaves 21 and 22 projecting outward from knuckles 25 and through which the hinge pin 28 extends. In the embodiment shown, the radial position of leaf 22 is adjusted relative to respective knuckles 25 so that when leaves 21 and 22 are rotated to a closed position in which the leaves 21 and 22 extend in parallel, juxtaposed alignment, and prior to installation, no gap or a nominal gap is formed between the leaves 21 and 22 and the leaves 21 and 22 may be described as extending in abutting relationship. Reduced gap hinge 20 with no gap between the leaves 21 and 22 in the closed position may be referred to as a zero gap replacement hinge 20.

Figure 4:
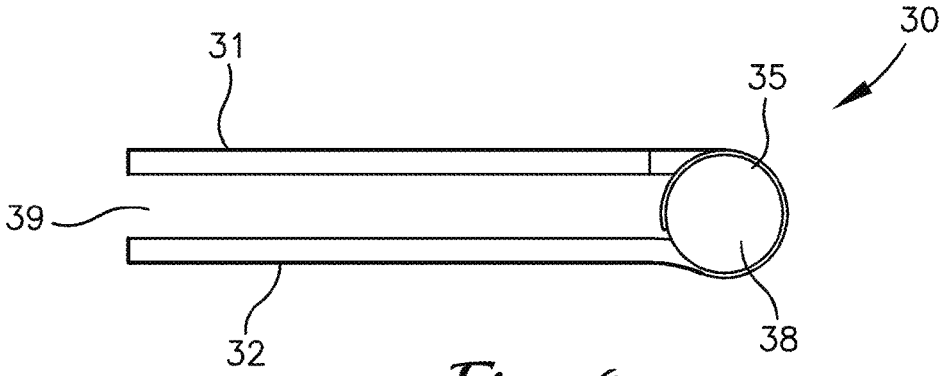
FIG. 4 is an end view of a second modified hinge which has been modified to increase the size of the gap between the leaves of the hinge when extending in parallel spaced relation.
Figure 5:
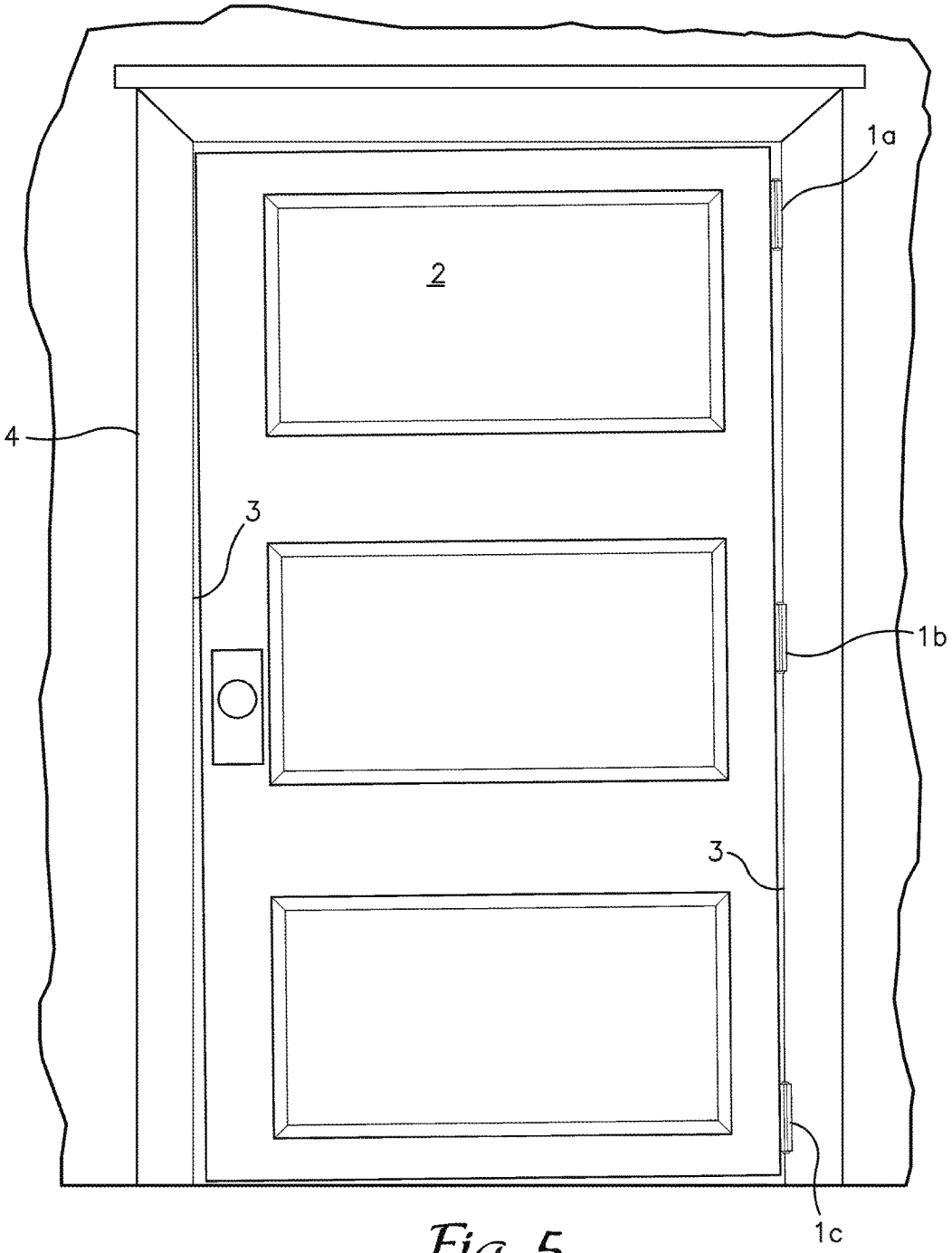
FIG. 5 is a diagrammatic view of a door hung in a door frame with the door connected to a door jamb by three conventional hinges and showing the door sagging relative to the door frame. The dimensions and position of the hinges relative to the door jamb are not to scale and are exaggerated to facilitate explaining the method of rehanging a door in a door frame and describing the hinges used.
Figure 6:
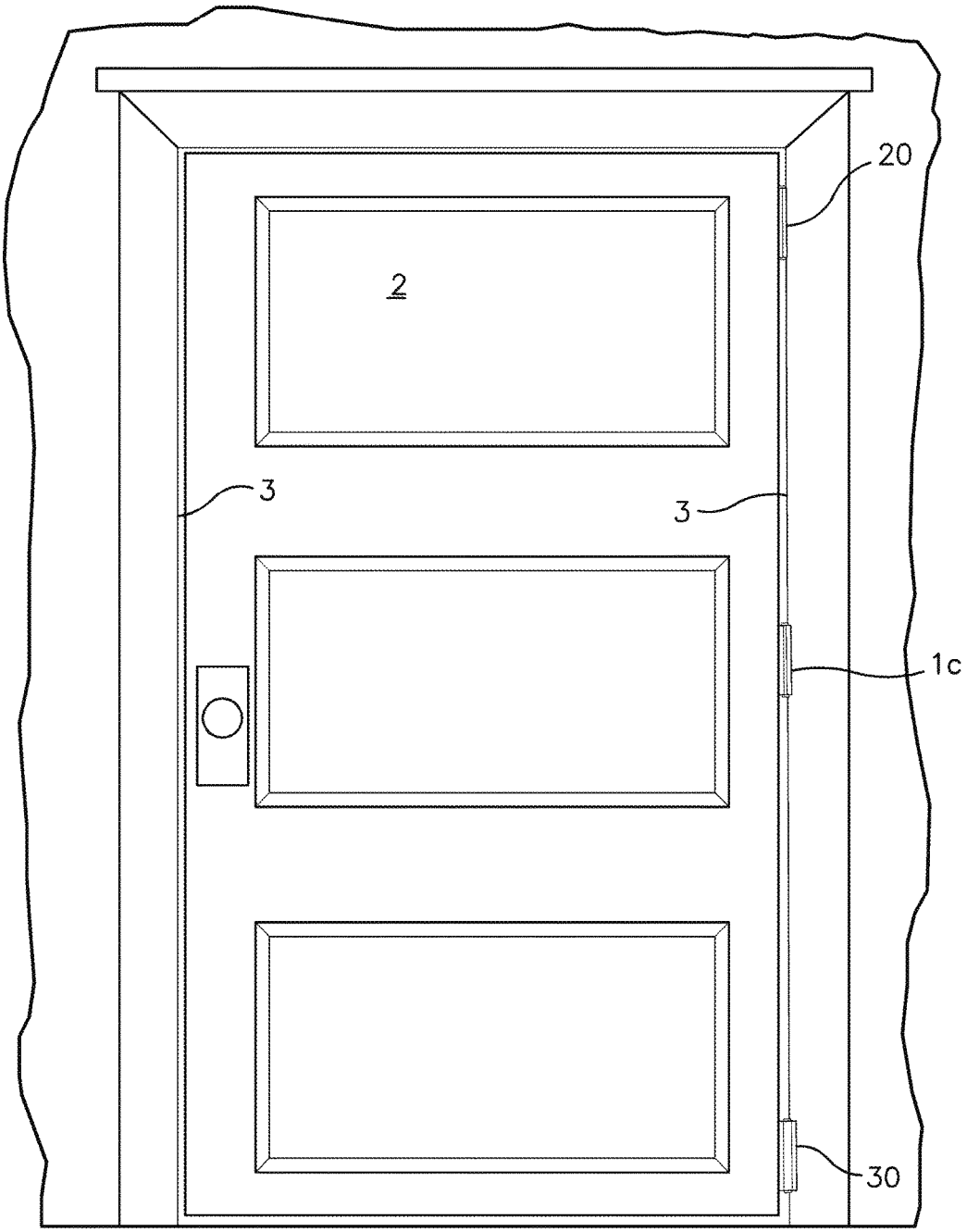
FIG. 6 is a diagrammatic view of the door shown in FIG. 5 with the upper hinge replaced with the first modified hinge and the lower hinge replaced with the second modified hinge. The dimensions and position of the hinges relative to the door jamb are not to scale and are exaggerated to facilitate explaining the method of rehanging a door in a door frame and describing the hinges used.

Referring to FIG. 4, there is shown a second replacement hinge or enlarged gap hinge 30 having first and second leaves 31 and 32 projecting outward from knuckles 35 and 36 and through which the hinge pin 38 extends. In the embodiment shown, the radial position of leaf 32 is adjusted relative to respective knuckles 35 so that when leaves 31 and 32 are rotated to a closed position in which the leaves 31 and 32 extend in parallel, juxtaposed alignment, and prior to installation, the gap 39 formed between the leaves 31 and 32 is wider than the gap 16 formed between leaves 7 and 8 of conventional hinge 1. The radial position of leaf 32 is adjusted to extend generally tangentially to the knuckles 35 to which it is attached. In one embodiment, the gap 39 between the parallel extending leaves 31 and 32 is approximately ⅜ of an inch versus a gap of 3⁄16 of an inch for the gap 16 formed between parallel extending leaves 7 and 8 of a conventional hinge 1. However it is foreseen that multiple increased gap hinges 30 may be produced with variations in the width of the gap 39.

In one approach to rehanging a door 2 that has sagged, only the top hinge 1*a* might be replaced with a reduced gap hinge 20. Replacing top hinge 1*a* with reduced gap hinge 20 will draw the top hinge side corner of the door 2 closer to the upper portion of the door jamb 3 on the hinge side and pull the opposite upper corner of the door 2 away from the door jamb 3 opposite the reduced gap hinge 20. This repair may be sufficient to correct the sagging of the door 2 and eliminate the binding of the door 2 with door jamb 3.

In an alternative approach, in addition to replacing top hinge 1*a* with reduced gap hinge 20, the bottom hinge 1*c* may be replaced with the enlarged gap hinge 30. Replacing bottom hinge 1*c* with an enlarged gap hinge 30, pushes the bottom, hinge side corner of the door 2 away from the door jamb 3 on the hinge side to produce a more consistent reveal between the door 2 and jamb 3 and reduce any binding between the bottom hinge side corner of the door 2 and the adjacent portion of the jamb 3. Typically, the middle hinge 1*b* will not be replaced.

When replacing the hinges 1*a* and 1*c* with reduced gap and enlarged gap hinges 20 and 30 respectively, the installer may reuse the screws used to secure hinges 1*a* and 1*c* to the door 2 and jamb 3. Alternatively, the installer may select slightly longer screws if preferred. Fastener receiving holes formed in the hinges 20 and 30 may be sized and spaced to correspond to fastener holes 14 of conventional hinges 1. It is also foreseen that the location of the fastener holes in the leaves 21 and 22 of reduced gap hinge 20 and the holes in the leaves 31 and 32 of the enlarged gap hinge 30 may be modified relative to the fastener holes 14 in leaves 7 and 8 of hinges 1, so that the fasteners used to connect the modified hinges 20 and 30 to the door 2 and jamb 3 bore into different portions of the door 2 or jamb 3.

Figure 7:
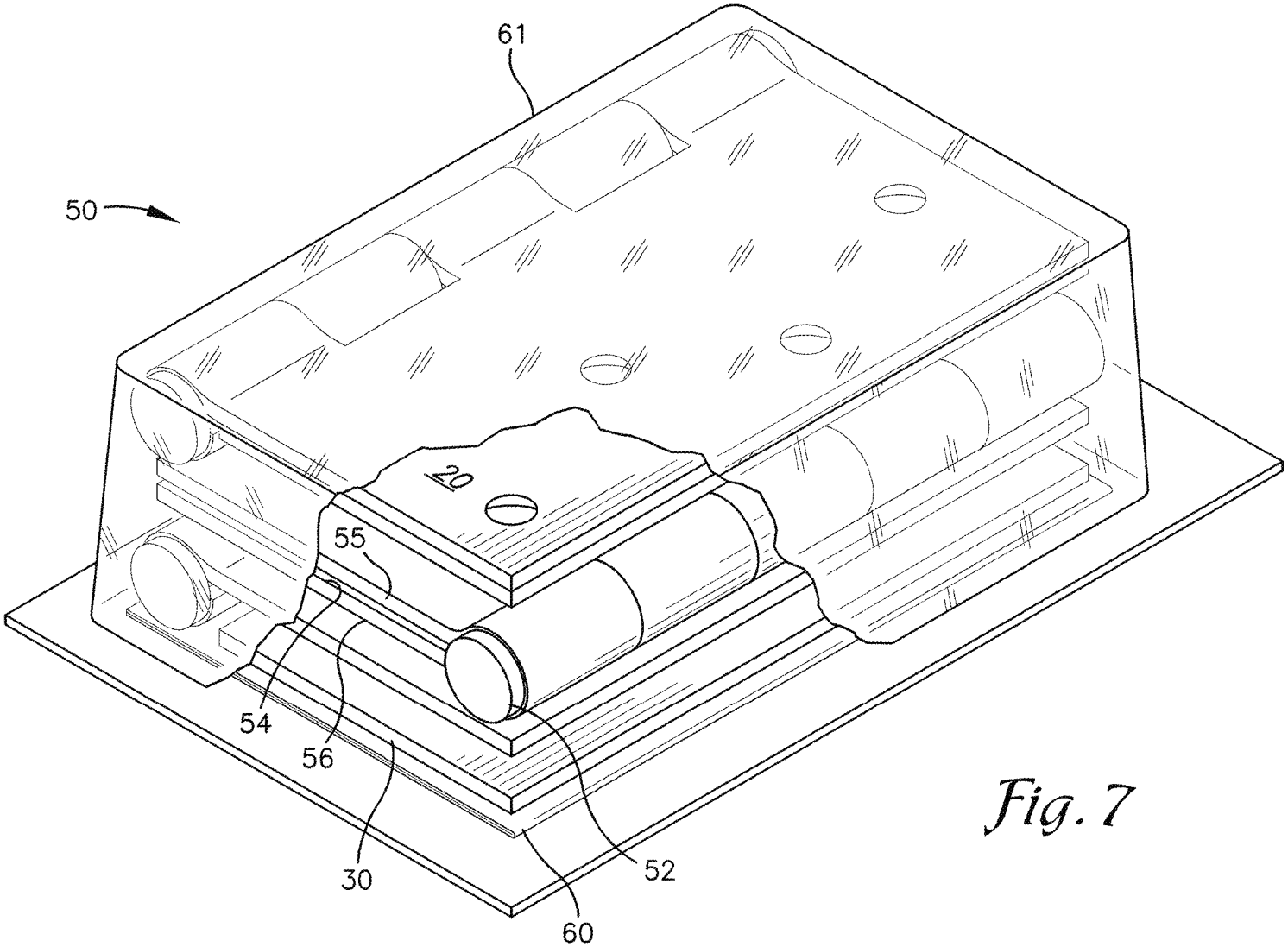
FIG. 7 is a perspective view of a kit including three replacement hinges and an instruction sheet for using the hinges bundled together in a plastic package.

A kit 50 consisting of a reduced gap hinge 20 and one or more additional replacement hinges having gaps 39 of a variety of widths with installation instructions may be distributed through selected channels such as retail hardware stores. The kit 50 shown in FIG. 7 includes a first reduced gap replacement hinge 20, a second reduced gap replacement hinge 52 and one enlarged gap replacement hinge 30.

The first reduced gap replacement hinge is a zero gap replacement hinge 20 as shown in FIG. 3. The second reduced gap replacement hinge 52 has a gap 54 between leaves 55 and 56 extending in parallel, juxtaposed alignment, prior to installation, that is dimensioned greater than zero but less than the dimension of the gap 16 of a conventional hinge 1. In one example, if the gap 16 of the conventional hinge is ¼ of an inch, the gap 54 of second reduced gap replacement hinge 52 might be ⅛ of an inch. The second reduced gap replacement hinge 52 might be used in lieu of the zero gap replacement hinge 20 if the degree to which the door has sagged is limited or for other reasons relating to fit or spacing. Instructions 60 may be packaged in a plastic shell type package 61 with the hinges 20, 52 and 30 and provide instructions for a user to install the replacement hinges in the manner described previously.

Alternatively it is foreseen that reduced gap hinges 20 and enlarged gap hinges 30 may be sold individually depending on the installer's needs. Reduced gap and increased gap hinges 20 and 30 of a variety of leaf shapes and finishes may also be provided. For examples, leaves 21 and 22 and 31 and 32 may have square or rounded corners. The hinges 20 and 30 may be manufactured with a variety of finishes including brass or a silver finish. In addition, the number of fastener holes 14 formed in the leaves of the hinges 20 and 30 may vary.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A method for rehanging a door connected to a door jamb by a plurality of hinges, said method comprising:

replacing one or more of the plurality of hinges with one or more replacement hinges selected from a set of replacement hinges including, one or more reduced gap replacement hinges having a pair of leaves with each leaf having a front surface and a rear surface that are both flat, planar and uniform surfaces in their entirety, connected via respective knuckles and a pin about which the pair of leaves are pivotable, and which when pivoted to a closed position in which the pair of leaves extend in parallel, juxtaposed alignment, prior to installation, have a fixed, non-adjustable, reduced dimension gap formed therebetween which is narrower than a gap formed between leaves of the one or more of the plurality of hinges when in the closed position, and one or more enlarged gap replacement hinges having a pair of leaves with each leaf having a front surface and a rear surface that are both flat, planar and uniform surfaces in their entirety, connected via respective knuckles and a pin about which the pair of leaves are pivotable, and which when pivoted to the closed position in which the pair of leaves extend in parallel, juxtaposed alignment, prior to installation, have a fixed, non-adjustable, enlarged dimension gap formed therebetween which is wider than the gap formed between the leaves of the one or more of the plurality of hinges when in the closed position, wherein the one or more replacement hinges are selected for replacing the one or more of the plurality of hinges so as to adjust a width of a reveal between the door and the door jamb such that, after installation, the door is realigned relative to the door jamb and is able to open and close essentially without contacting the door jamb.

2. The method as in claim 1, wherein, prior to installation:

the gap formed between the leaves of the one or more of the plurality of hinges is between 3/16" and 5/16" wide;

the fixed, non-adjustable, reduced dimension gap formed between the pair of leaves of the one or more reduced gap replacement hinges is between 0" and 3/16" wide; and the fixed, non-adjustable, enlarged dimension gap formed between the pair of leaves of the one or more enlarged gap replacement hinges is between 5/16" and ½" wide.

3. The method as in claim 2, wherein:

the one or more reduced gap replacement hinges include a first reduced gap replacement hinge and a second reduced gap replacement hinge, wherein the fixed, non-adjustable, reduced dimension gap of the first reduced gap replacement hinge is approximately 0" to 1/16" wide, and the fixed, non-adjustable, reduced dimension gap of the second reduced gap replacement hinge is approximately 1/16" to 3/16" wide, the one or more enlarged gap replacement hinges include a first enlarged gap replacement hinge and a second enlarged gap replacement hinge, wherein the fixed, non-adjustable, enlarged dimension gap of the first enlarged gap replacement hinge is approximately 5/16" to 7/16" wide, and the fixed, non-adjustable, enlarged dimension gap of the second enlarged gap replacement hinge is approximately 7/16" to ½" wide, and the replacing the one or more of the plurality of hinges with the one or more replacement hinges selected from the set of replacement hinges comprises replacing an uppermost conventional hinge with the first reduced gap replacement hinge or with the second reduced gap replacement hinge, and replacing a lowermost conventional hinge with the first enlarged gap replacement hinge or with the second enlarged gap replacement hinge, depending on an amount of adjustment required to realign the door relative to the door jamb and ensure that the door is able to open and close essentially without contacting the door jamb.

4. The method as in claim 1, wherein the replacing the one or more of the plurality of hinges with the one or more replacement hinges selected from the set of replacement hinges enables a position or orientation of the door in relation to the door jamb to be adjusted in different ways upon installation, depending on a type of adjustment required to realign the door relative to the door jamb and ensure that the door is able to open and close essentially without contacting the door jamb, including any of, replacing at least two of the plurality of hinges with at least two of the one or more reduced gap replacement hinges to pull the door towards a hinge side of the door jamb, replacing at least two of the plurality of hinges with at least two of the one or more enlarged gap replacement hinges to push the door away from the hinge side of the door jamb, replacing an uppermost hinge of the plurality of hinges with one of the one or more reduced gap replacement hinges, and replacing a lowermost hinge of the plurality of hinges with one of the one or more enlarged gap replacement hinges, to rotate the door in a clockwise direction relative to the doorjamb, and replacing the uppermost hinge of the plurality of hinges with one of the one or more enlarged gap replacement hinges, and replacing the lowermost hinge of the plurality of hinges with one of the one or more reduced gap replacement hinges, to rotate the door in a counter-clockwise direction relative to the door jamb.

5. The method as in claim 1, wherein:

the pair of leaves of the one or more reduced gap replacement hinges and the pair of leaves of the one or more enlarged gap replacement hinges each have a thickness and dimensions similar to each other, and similar to a thickness and dimensions of the pair of leaves of the plurality of hinges, and installing the one or more replacement hinges selected from the set of replacement hinges does not require any structural modification to the door or to the door jamb.

6. The method as in claim 1, wherein, prior to installation:

the gap formed between the leaves of the one or more of the plurality of hinges is between ⅛" and 3⁄16" wide;

the fixed, non-adjustable, reduced dimension gap formed between the pair of leaves of the one or more reduced gap replacement hinges is between 0" and ⅛" wide; and the fixed, non-adjustable, enlarged dimension gap formed between the pair of leaves of the one or more enlarged gap replacement hinges is between 3⁄16" and ⅜" wide.

7. A method for rehanging a door connected to a door jamb by a plurality of hinges using at least two replacement hinges selected from a set of replacement hinges for replacing at least two of the plurality of hinges, said method comprising:

replacing an uppermost hinge of the plurality of hinges with a first reduced gap replacement hinge having a pair of leaves with each leaf having a front surface and a rear surface that are both flat, planar and uniform surfaces in their entirety, connected via respective knuckles and a pin about which the pair of leaves are pivotable, and which when pivoted to a closed position in which the pair of leaves extend in parallel, juxtaposed alignment, prior to installation, have a fixed, non-adjustable, reduced dimension gap formed therebetween which is narrower than a gap formed between leaves of the uppermost hinge of the plurality of hinges when in the closed position; and replacing a lowermost hinge of the plurality of hinges with a first enlarged gap replacement hinge having a pair of leaves with each leaf having a front surface and a rear surface that are both flat, planar and uniform surfaces in their entirety, connected via respective knuckles and a pin about which the pair of leaves are pivotable, and which when pivoted to the closed position in which the pair of leaves extend in parallel, juxtaposed alignment, prior to installation, have a fixed, non-adjustable, enlarged dimension gap formed therebetween which is wider than a gap formed between leaves of the lowermost hinge of the plurality of hinges when in the closed position, wherein the at least two replacement hinges are selected for replacing the at least two of the plurality of hinges so as to adjust a width of a reveal between the door and the door jamb such that, after installation, the door is realigned relative to the door jamb and is able to open and close essentially without contacting the door jamb.

8. The method as in claim 7, said method further comprising, in response to further adjustment being required, after replacing the uppermost hinge of the plurality of hinges with the first reduced gap replacement hinge and replacing the lowermost hinge of the plurality of hinges with the first enlarged gap replacement hinge, to realign the door relative to the door jamb and ensure that the door is able to open and close essentially without contacting the door jamb, at least one of:

replacing the first reduced gap replacement hinge with a second reduced gap replacement hinge having a pair of leaves with each leaf having a front surface and a rear surface that are both flat, planar and uniform surfaces in their entirety, connected via respective knuckles and a pin about which the pair of leaves are pivotable, and which when pivoted to a closed position in which the pair of leaves extend in parallel, juxtaposed alignment, prior to installation, have a fixed, non-adjustable, reduced dimension gap formed therebetween which is narrower than the gap formed between the pair of leaves of the first reduced gap replacement hinge when in the closed position; and replacing the first enlarged gap replacement hinge with a second enlarged gap replacement hinge having a pair of leaves with each leaf having a front surface and a rear surface that are both flat, planar and uniform surfaces in their entirety, connected via respective knuckles and a pin about which the pair of leaves are pivotable, and which when pivoted to the closed position in which the pair of leaves extend in parallel, juxtaposed alignment, prior to installation, have a fixed, non-adjustable, enlarged dimension gap formed therebetween which is wider than the gap formed between the pair of leaves of the first enlarged gap replacement hinge when in the closed position.

* * * * *